US011174119B2

(12) United States Patent
Chihara et al.

(10) Patent No.: US 11,174,119 B2
(45) Date of Patent: Nov. 16, 2021

(54) SHEET SORTING APPARATUS AND IMAGE FORMING APPARATUS

(71) Applicant: CANON KABUSHIKI KAISHA, Tokyo (JP)

(72) Inventors: Hiroshi Chihara, Suntou-gun (JP); Genki Takahashi, Mishima (JP); Kazuhisa Sato, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 16/276,316

(22) Filed: Feb. 14, 2019

(65) Prior Publication Data

US 2019/0263620 A1 Aug. 29, 2019

(30) Foreign Application Priority Data

Feb. 26, 2018 (JP) ..... JP2018-032598

(51) Int. Cl.
*B65H 31/24* (2006.01)
*B65H 31/22* (2006.01)
(Continued)

(52) U.S. Cl.
CPC ..... *B65H 31/24* (2013.01); *B65H 29/60* (2013.01); *B65H 31/22* (2013.01); *B65H 39/11* (2013.01); *B65H 43/08* (2013.01); *B65H 2405/11* (2013.01)

(58) Field of Classification Search
CPC ... B65H 7/02; B65H 7/04; B65H 7/14; B65H 7/20; B65H 29/12; B65H 29/14; B65H 29/20; B65H 29/22; B65H 29/26; B65H 29/58; B65H 29/60; B65H 31/22; B65H 31/24; B65H 39/11; B65H 43/00; B65H 43/02; B65H 43/06; B65H 43/08; B65H 2405/332; B65H 2405/3322; B65H 2408/111; B65H 2511/51; B65H 2511/515; B65H 2513/50; B65H 2513/51; B65H 2513/511; B65H 2405/11
See application file for complete search history.

(56) References Cited

U.S. PATENT DOCUMENTS 6,443,449 B1 * 9/2002 Takagi ..... B65H 31/22 271/279
2002/0118351 A1 * 8/2002 Takoh ..... B65H 39/11 355/72

FOREIGN PATENT DOCUMENTS

JP 200044105 A 2/2000
JP 2000255888 A 9/2000
JP 2002249273 A 9/2002

* cited by examiner

*Primary Examiner* — Prasad V Gokhale
(74) *Attorney, Agent, or Firm* — Canon U.S.A., Inc. I.P. Division

(57) ABSTRACT

A sheet sorting apparatus includes a second tray arranged below a first tray detachable from a main body having a first discharge port corresponding to the first tray and a second discharge port corresponding to the second tray, a discharge unit, a tray detecting unit, and a control unit. The discharge unit discharges a sheet toward the first or second discharge port. In a state that the first tray is detached from the main body and the discharge unit discharges sheets from the first discharge port to the second tray and then the first tray is detected as attached to the main body, the control unit selects a discharge destination of a second sheet, subsequent to a first sheet discharged and stacked first after the first tray is attached to the main body, such that the second sheet is stacked on a tray having the first sheet thereon.

14 Claims, 11 Drawing Sheets

(51) Int. Cl.

| | |
|---|---|
| ***B65H 43/08*** | (2006.01) |
| ***B65H 39/11*** | (2006.01) |
| ***B65H 29/60*** | (2006.01) |

SHEET SORTING APPARATUS AND IMAGE FORMING APPARATUS

BACKGROUND OF THE INVENTION

Field of the Invention

The present disclosure relates to a sheet sorting apparatus and an image forming apparatus which have a plurality of discharge trays including a detachable discharge tray.

Description of the Related Art

Some of conventional image forming apparatuses may include a sheet sorting apparatus having a plurality of discharge trays. Such an apparatus has different discharge trays for users, for example, to sort and discharge sheets thereto, for example.

Japanese Patent Laid-Open No. 2000-44105 discloses a sheet sorting apparatus having a plurality of discharge trays that is detachable from an apparatus main body of the apparatus. For example, a first tray of the plurality of discharge trays may be detached to increase a space for stacking sheets (sheet stacking space) of a second tray arranged below the first tray so that a maximum number of sheets to be stacked in the second tray can be increased.

The sheet sorting apparatus according to Japanese Patent Laid-Open No. 2000-44105, after the first tray is detached, changes a port from which a sheet is discharged such that the sheet can be discharged from one located at a position corresponding to the first tray instead of another one located at a position corresponding to the second tray. The sheet discharged from the discharge port located at the position corresponding to the first tray falls to and is stacked on the second tray.

However, in a case where the first tray is attached to the apparatus main body again while a sheet is being sorted to the second tray, the sheet to be discharged to the second tray may possibly improperly be discharged to the first tray. After that, when the sheet sorting apparatus detects the attachment of the first tray and changes the sheet discharge port to discharge a subsequent sheet to the designated second tray, sheets belonging to one job may be stacked on different trays, disadvantageously preventing the maintenance of the page order of the sheets.

SUMMARY OF THE INVENTION

The present disclosure relates to a sheet sorting apparatus that can sort sheets such that the page order of the sheets can be maintained in a case where a first tray is attached to an apparatus main body again while a sheet is being sorted.

According to an aspect of the present disclosure, a sheet sorting apparatus includes a first tray detachable from an apparatus main body, a second tray arranged below the first tray, wherein the apparatus main body has a first discharge port at a position corresponding to the first tray and a second discharge port at a position corresponding to the second tray, a discharge unit configured to discharge a sheet toward the first discharge port or the second discharge port, a tray detecting unit configured to detect that the first tray is attached to the apparatus main body, and a control unit configured to select, wherein, in a state that the first tray is detached from the apparatus main body and the discharge unit discharges sheets from the first discharge port to the second tray and then the tray detecting unit detects that the first tray is attached to the apparatus main body, the control unit is configured to select a discharge destination by the discharge unit of a second sheet, subsequent to a first sheet discharged and stacked first after the first tray is attached to the apparatus main body, such that the second sheet is stacked on a tray having the first sheet thereon.

Further features of the present disclosure will become apparent from the following description of embodiments with reference to the attached drawings.

DESCRIPTION OF THE EMBODIMENTS

Embodiment 1

Configuration of Image Forming Apparatus

Figure 1:
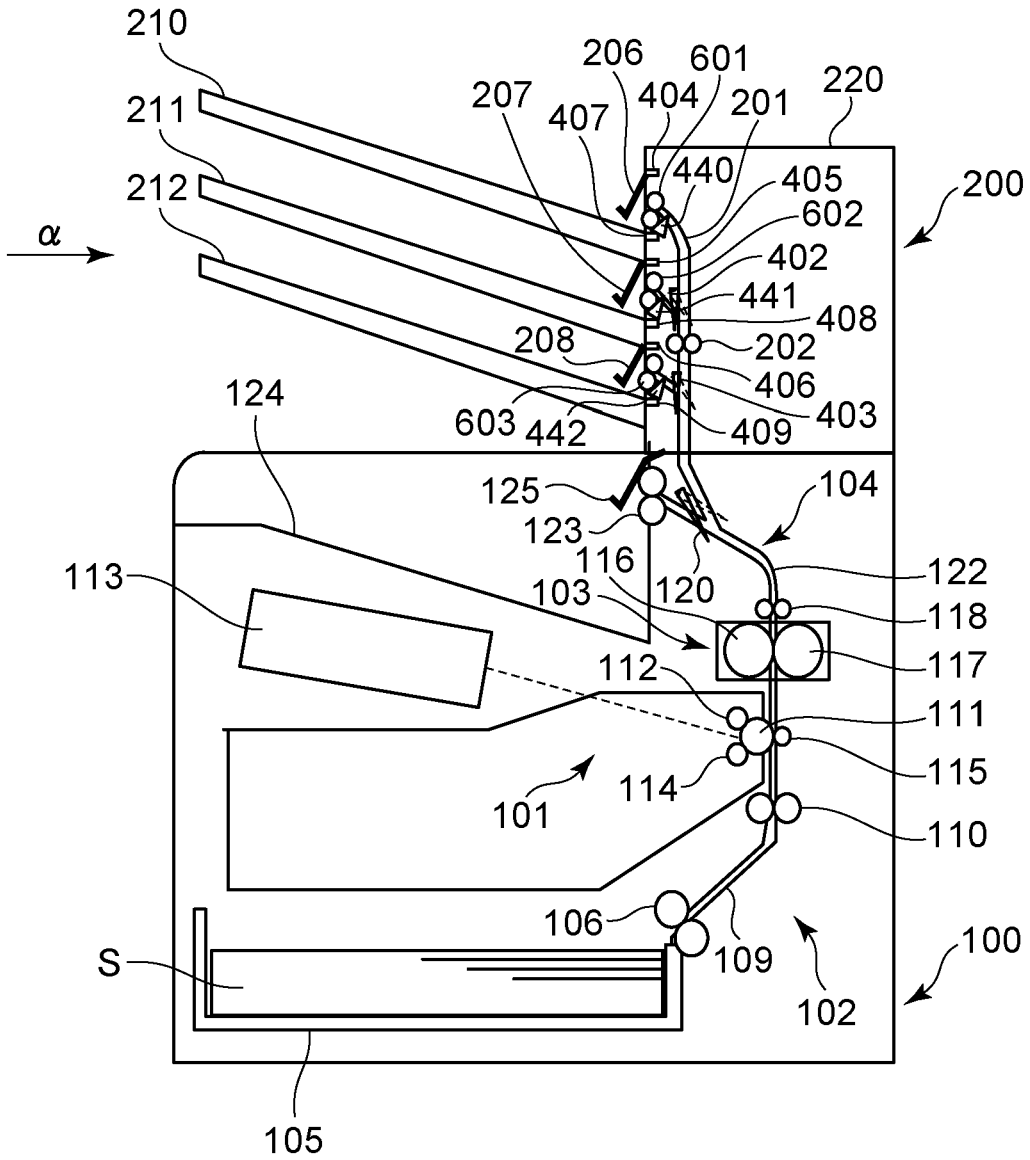
FIG. 1 illustrates configurations of an image forming apparatus and a sheet sorting apparatus according to Embodiment 1.

FIG. 1 illustrates a schematic structure of an image forming apparatus according to Embodiment 1 of the present disclosure. FIG. 1 illustrates a laser beam printer 100 (hereinafter, printer 100) as an image forming apparatus according to this embodiment.

As illustrated in FIG. 1, the printer 100 includes an image forming unit 101, a feed unit 102 configured to feed a sheet S (recording material) of paper, for example, to the image forming unit 101, a fixing unit 103 configured to fix an image formed on the sheet S by the image forming unit 101, and a discharge unit 104. A sheet sorting apparatus 200 is provided above the printer 100 and is configured to receive from the printer 100 and sort sheets S having images formed thereon.

The image forming unit 101 has a photosensitive drum 111 configured to rotate in counterclockwise direction in FIG. 1, a charging roller 112 configured to charge a surface of the photosensitive drum 111, and an exposure device 113 configured to apply light to the charged photosensitive drum 111 to form an electrostatic latent image on the photosensitive drum 111. The image forming unit 101 further has a developing apparatus 114 configured to place toner onto the electrostatic latent image to form a toner image on the photosensitive drum 111, and a transfer roller 115 configured to transfer the toner image onto a conveyed sheet S. The image forming unit 101 is configured to form a toner image onto a sheet S by performing an image forming process. The fixing unit 103 has a fixing roller 116 and a pressurizing roller 117 configured to form a fixing nip portion with the fixing roller 116 and is configured to apply heat and pressure to a sheet S to fix the transferred toner image to the sheet S.

The feed unit 102 has a cassette 105 configured to contain in a stacking manner a plurality of sheets S to be used for image forming thereon, a feeding roller 106, a conveyance guide 109, and a registration roller 110. The discharge unit 104 has a switch member 120, a fix/discharge roller 118, a discharge guide 122, a discharge roller 123, a discharge tray 124, and a full stack detection flag 125. If a fully-stacked condition or a full stack of the discharge tray 124 is detected based on the full stack detection flag 125, the printer 100 does not discharge a sheet S to the discharge tray 124 until removal of the sheets S discharged to the discharge tray 124.

The switch member 120 is configured to be capable of being moved by an actuator, not illustrated, to a position indicated by the solid line in FIG. 1 for guiding a sheet S having undergone image forming to the sheet sorting apparatus 200 and to a position indicated by the broken line in FIG. 1 for guiding to the discharge tray 124.

Configuration of Sheet Sorting Apparatus

Next, with reference to FIG. 1, the sheet sorting apparatus 200 according to this embodiment will be described. A conveyance guide 201 is configured to guide a sheet S conveyed from the printer 100. The conveyance guide 201 has a plurality of branch points and diverges to discharge trays 210, 211, and 212. A conveyance roller pair 202 and discharge roller pairs 601, 602, and 603 are configured to discharge a sheet S to one of the discharge trays 210, 211, and 212. The discharge trays 210, 211, and 212 are arbitrarily detachable from the apparatus main body 220 (or a housing) of the sheet sorting apparatus 200. Here, a switch member 402 and a switch member 403 are configured to be capable of being moved by an actuator, not illustrated, to the position indicated by the solid line and the position indicated by the broken line in FIG. 1. For example, in order to discharge a sheet S to the discharge tray 210, the switch member 402 and the switch member 403 are moved to the position indicated by the solid line in FIG. 1. In order to discharge a sheet S to the discharge tray 211, the switch member 402 is moved to the position indicated by the broken line in FIG. 1, and the switch member 403 is moved to the position indicated by the solid line indicated in FIG. 1.

Tray detecting sensors 407, 408, and 409 are sensors configured to detect that the discharge trays 210, 211, and 212, respectively, are attached to the apparatus main body 220. The tray detecting sensors 407, 408, and 409 may be photo-interruptors, for example, and each is configured to output an OFF signal in a through-beam mode in which the corresponding one of the discharge trays 210, 211, and 212 is detached from the apparatus main body 220 so that a light beam from the photo-interruptor is not shielded. Each of the tray detecting sensors 407, 408, and 409 is configured to output an ON signal in a beam shielded mode in which the corresponding one of the discharge trays 210, 211, and 212 is attached to the apparatus main body 220 to shield light beams from the photo-interruptors.

Full stack detection flags 206, 207, and 208 are flags each configured to move in contact with a surface of a sheet S discharged to the corresponding one of the discharge trays 210, 211, and 212. Full stack detecting sensors 404, 405, and 406 are sensors configured to detect a fully-stacked condition of the discharge trays 210, 211, and 212, respectively. The full stack detecting sensors 404, 405, and 406 may be photo-interruptors, for example, and be configured to output an OFF signal in a through-beam mode in which light beams are not shielded by the full stack detection flags 206, 207, 208, respectively. When a sheet S is discharged to one of the discharge trays 210, 211, and 212, the corresponding one of the full stack detection flags 206, 207, 208 moves. The corresponding one of the full stack detecting sensors 404, 405, and 406 outputs an ON signal in a beam-shielded mode in which a light beam is shielded by the corresponding one of the full stack detection flags 206, 207, and 208. Here, the term "full stack" or "fully-stacked condition" refers to a state that the number of stacked sheets S after discharged to the discharge tray 210, 211, or 212 is equal to or higher than a predetermined number. According to this embodiment, the full stack detection flag 207 integrated with the discharge tray 210 and the full stack detection flag 208 integrated with the discharge tray 211 are detachable from the apparatus main body 220. In other words, the full stack detection flag 207 is attached to the discharge tray 210, and the full stack detection flag 208 is attached to the discharge tray 211.

Discharge detecting sensors 440, 441, and 442 are placed near the discharge roller pairs 601, 602, 603, respectively, and are configured to detect a sheet S discharged to outside of the apparatus main body 220. A sheet S discharged by the discharge roller pair 601 is detected by the discharge detecting sensor 440. A sheet S discharged by the discharge roller pair 602 is detected by the discharge detecting sensor 441. A sheet S discharged by the discharge roller pair 603 is detected by the discharge detecting sensor 442.

Figure 2:
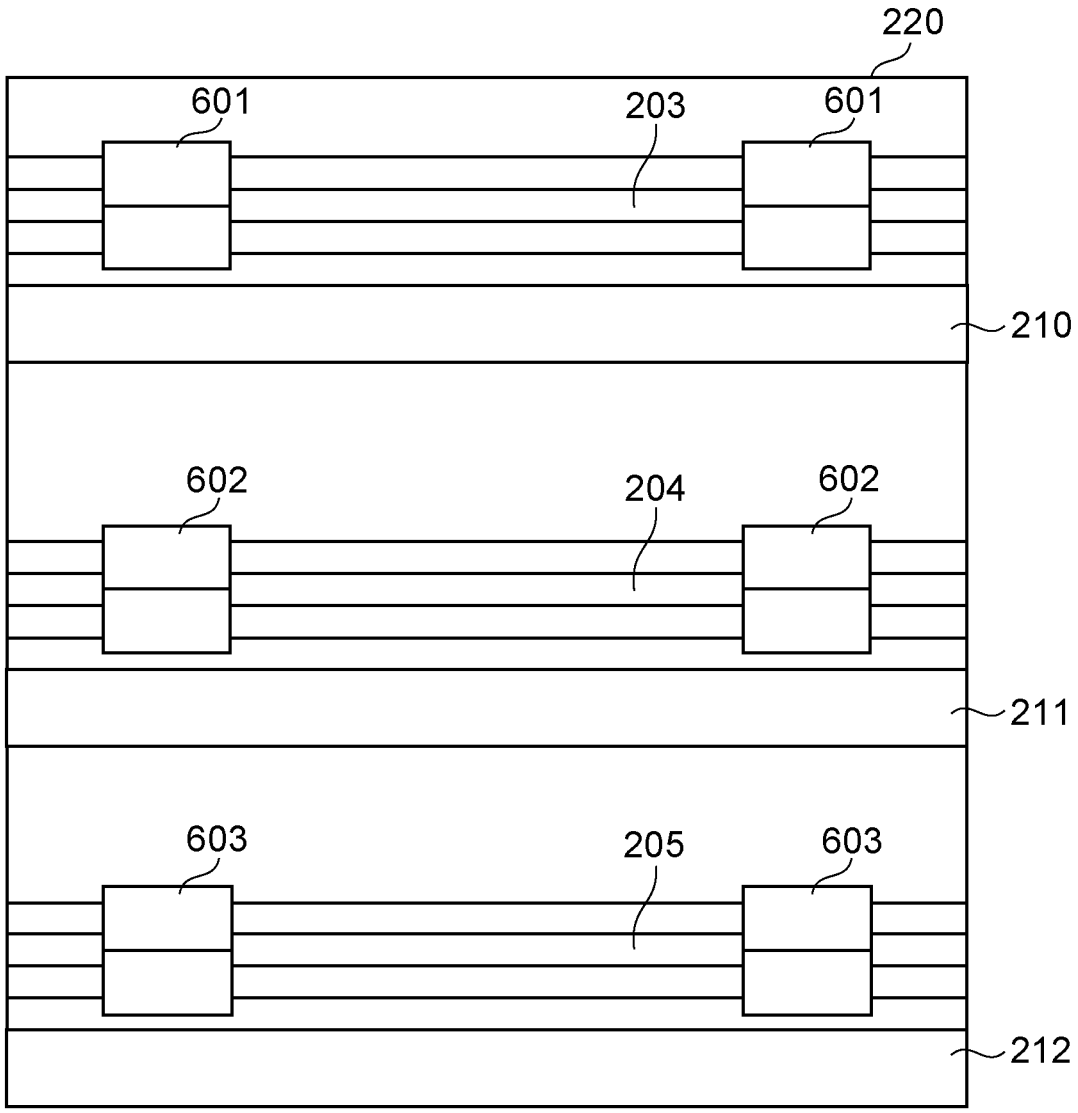
FIG. 2 is a front view of the sheet sorting apparatus according to Embodiment 1.

FIG. 2 illustrates the sheet sorting apparatus 200 illustrated in FIG. 1 viewed from a downstream side in the direction for discharging a sheet S (from a direction indicated by an arrow $\alpha$ in FIG. 1). FIG. 2 does not illustrate the full stack detection flags 206, 207, and 208. The apparatus main body 220 has discharge ports 203, 204, and 205, and sheets S discharged by the discharge roller pairs 601, 602, and 603 pass through the discharge ports 203, 204, and 205, respectively, which are openings. In other words, the discharge port 203 is provided at a position corresponding to the discharge tray 210, the discharge port 204 is provided at a position corresponding to the discharge tray 211, and the discharge port 205 is provided at a position corresponding to the discharge tray 212.

Control Unit and Functional Components

Figure 3:
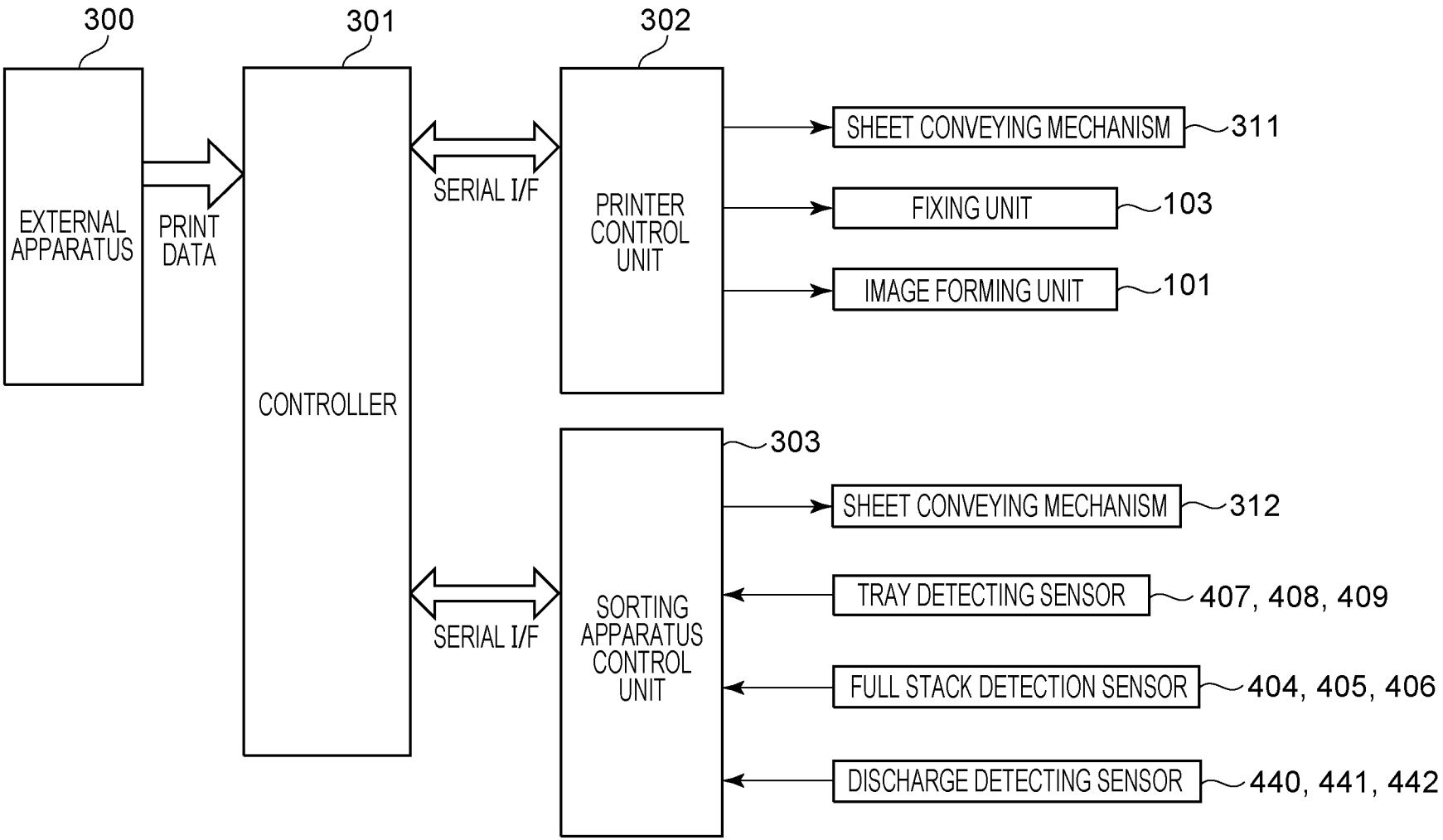
FIG. 3 is a block diagram illustrating a control unit and functional components in the image forming apparatus according to Embodiment 1.

FIG. 3 is a block diagram illustrating functional components according to this embodiment. The printer 100 includes, as a control unit, a controller 301, a printer control unit 302 configured to control the printer 100, and a sorting apparatus control unit 303 configured to control the sheet sorting apparatus 200. The controller 301 is configured to communicate with the external apparatus 300 such as a host computer to receive print data. The controller 301 is further configured to designate a print condition generated from the print data and give a print instruction to the printer control unit 302 via a serial I/F. The printer control unit 302 controls mechanisms in accordance with the print condition received from the controller 301. More specifically, the printer control unit 302 may control a sheet conveying mechanism 311 including a feed unit 102 and a discharge unit 104 to feed and discharge a sheet S and may control the image forming unit 101 and the fixing unit 103 to perform image forming and fixing on the sheet S.

The controller 301 is further configured to designate a sorting destination of a sheet S to the sorting apparatus control unit 303 via the serial I/F. The sorting apparatus control unit 303 is configured to control mechanisms in accordance with the sorting destination designated by the controller 301. More specifically, the sorting apparatus control unit 303 is configured to control a sheet conveying mechanism 312 including the conveyance roller pair 202, the discharge roller pairs 601, 602, and 603, and the switch members 402 and 403 to convey a sheet S having undergone image forming thereon. The sorting apparatus control unit 303 is further configured to detect the presence of the discharge trays 210, 211, and 212 based on detection results from the tray detecting sensors 407, 408, and 409. The sorting apparatus control unit 303 is further configured to detect fully-stacked conditions of the discharge trays 210, 211, and 212 based on detection results from the full stack detecting sensors 404, 405, and 406. The sorting apparatus control unit 303 detects that a sheet S is discharged by one of the discharge roller pairs 601, 602, and 603 based on detection results from the discharge detecting sensors 440, 441, and 442.

Details of Sorting Apparatus Control Unit

Figure 4:
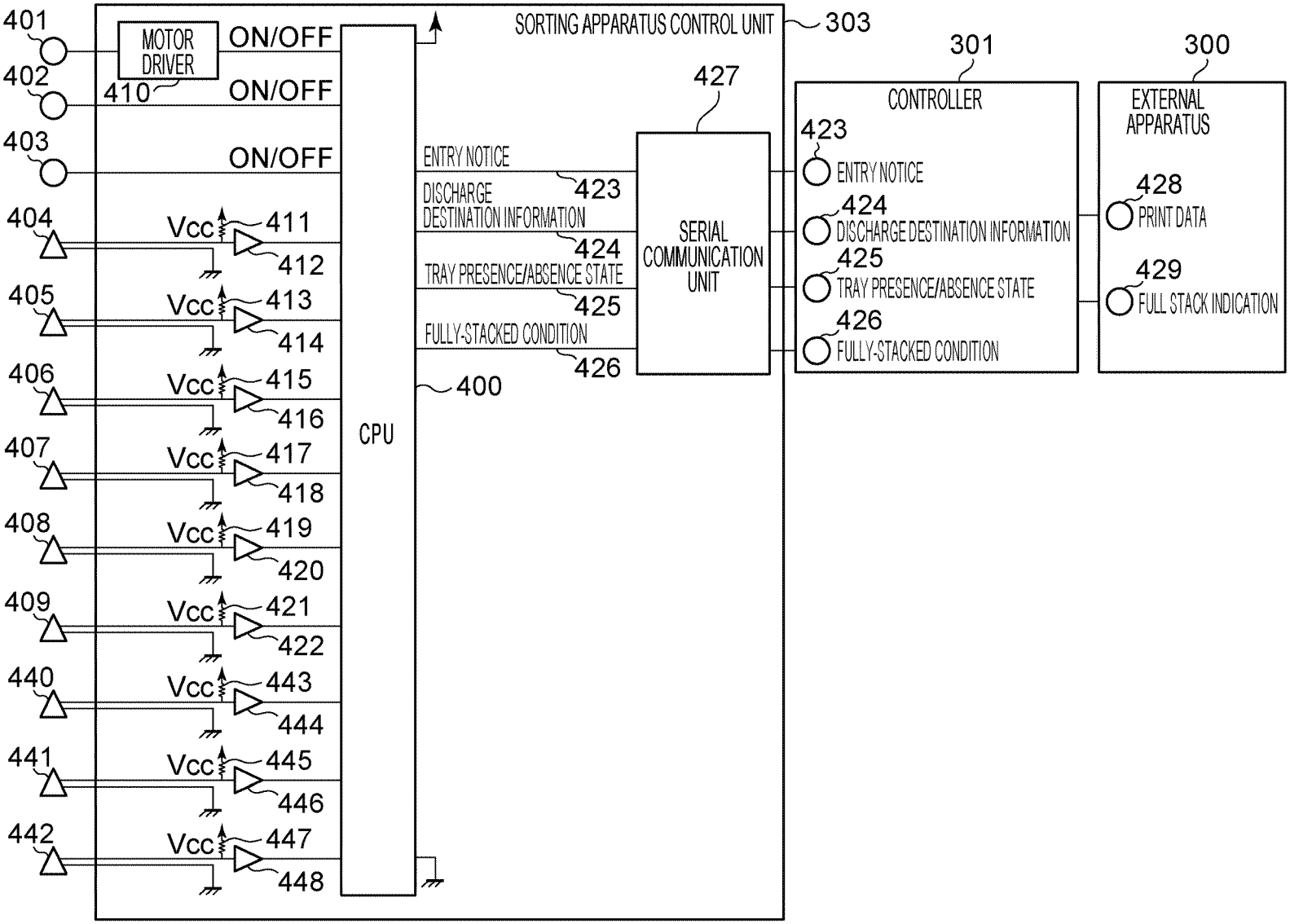
FIG. 4 illustrates details of the sorting apparatus control unit according to Embodiment 1.

FIG. 4 is a detail diagram illustrating the sorting apparatus control unit 303 according to this embodiment. The sorting apparatus control unit 303 has a CPU 400 and communicates with the controller 301 through a serial communication unit 427. The serial communication unit 427 connects the CPU 400 and the controller 301 via a plurality of signal lines.

When print data 428 are notified to the controller 301 through the external apparatus 300, the controller 301 notifies a signal representing an entry notice 423 and discharge destination information 424 to the CPU 400 through the serial communication unit 427. A signal representing a tray presence/absence state 425 is also notified from the CPU 400 to the controller 301 via the serial communication unit 427. When a signal representing a fully-stacked condition 426 is notified from the CPU 400 to the controller 301 via the serial communication unit 427, a full stack indication 429 is notified on the external apparatus 300. Here, the expression "a full stack indication 429 is notified" refers to display of a message or an image informing that a tray that is the discharge target of a sheet S has a fully-stacked condition on a screen of the external apparatus 300. The subject to display a message or an image notifying a fully stacked state is not limited to the external apparatus 300. A liquid crystal panel (display unit) may be provided on the printer 100 or the sheet sorting apparatus 200 so that the notification can be displayed on the panel.

A motor driver 410 is connected to an output terminal of the CPU 400. The motor driver 410 drives a conveyance motor 401. Rotation of the conveyance motor 401 can rotate the conveyance roller pair 202 and the discharge roller pairs 601, 602, 603 so that a sheet S is conveyed to one of the discharge trays 210, 211, and 212.

An actuator (not illustrated) for changing the position of the switch member 402 is connected to the output terminal of the CPU 400. When the actuator has an ON state, the switch member 402 is changed in its position into the position indicated by the broken line in FIG. 1 so that a sheet S is guided to the direction toward the discharge tray 211. When the actuator has an OFF state, the switch member 402 is changed in its position to the position indicated by the solid line in FIG. 1 so that a sheet S is guided to a direction toward the discharge tray 210.

An actuator (not illustrated) configured to change the position of the switch member 403 is connected to the output terminal of the CPU 400. When the actuator has an ON state, the switch member 403 is changed in its position to the position indicated by the broken line in FIG. 1 so that a sheet S can be guided to a direction toward the discharge tray 212. When the actuator has an OFF state, the switch member 403 is changed in its position to the position indicated by the solid line in FIG. 1 so that a sheet S is guided to a direction toward the discharge trays 210 and 211.

The full stack detecting sensor 404 uses a pull-up 411 and is configured to input a sensor state (an ON signal or an OFF signal) to the CPU 400 through a buffer 412. Because details of the full stack detecting sensors 405 and 406 are the same as those of the full stack detecting sensor 404, any repetitive description will be omitted.

The tray detecting sensor 407 uses a pull-up 417 and is configured to input a sensor state (an ON signal or an OFF signal) to the CPU 400 through a buffer 418. Because details of the tray detecting sensors 408 and 409 are the same as those of the tray detecting sensor 407, any repetitive descriptions will be omitted.

The discharge detecting sensor 440 uses a pullup 443 and is configured to input a sensor state (ON signal or OFF signal) to the CPU 400 through a buffer 444. Because details of the discharge detecting sensors 441 and 442 are the same as those of the discharge detecting sensor 440, any repetitive descriptions will be omitted.

Description of Operations after Discharge Tray is Detached.

Next, operations to be performed by the sheet sorting apparatus 200 will be described in a case where a discharge tray is detached from the apparatus main body 220. According to this embodiment, a case will be described in which the discharge tray 210 is detached from the apparatus main body 220.

Figure 5C:
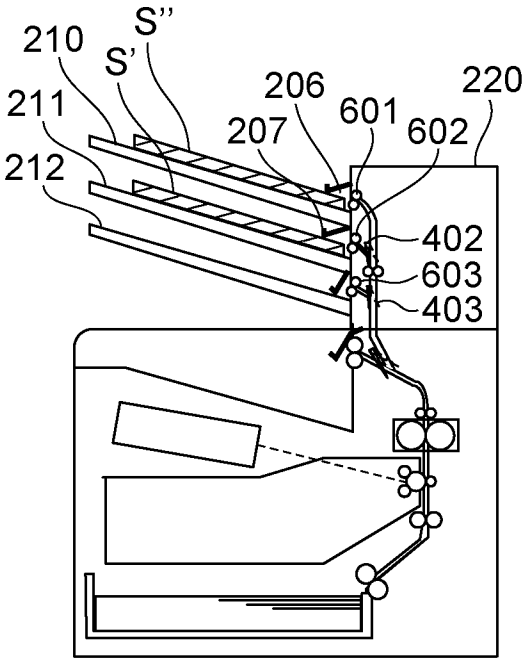
FIGS. 5A to 5C illustrate a state that a discharge tray is detached and a state that the discharge tray is attached again.
Figure 5B:
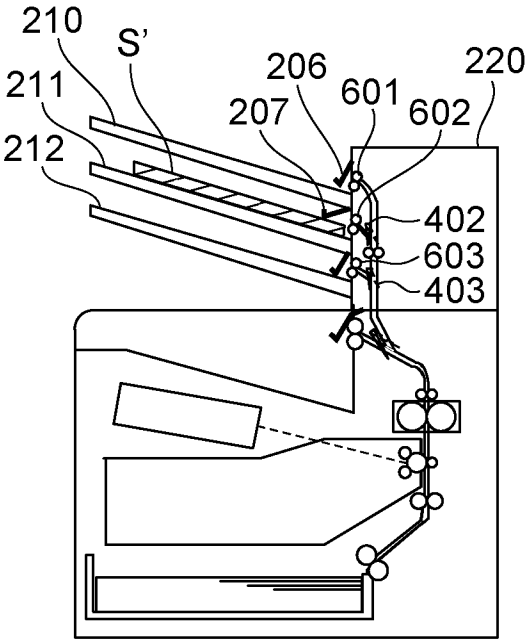
Figure 5A:
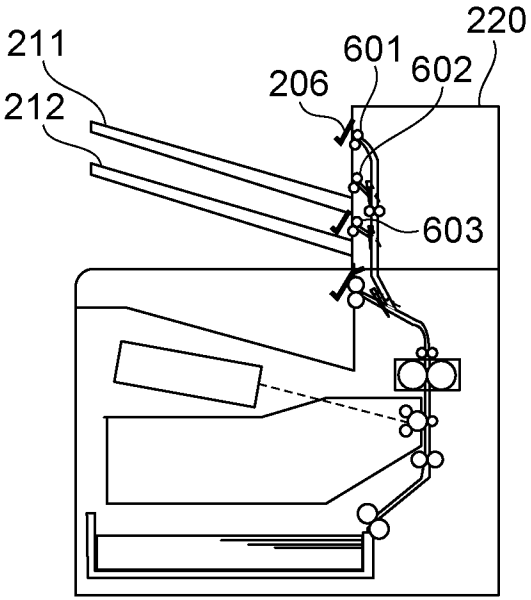

FIG. 5A illustrates a state that the discharge tray 210 is detached from the apparatus main body 220. The full stack detection flag 207 is also detached along with the discharge tray 210. Thus, sheets S can be discharged to the discharge tray 211 until the full stack detection flag 206 detects a fully stacked state thereof. In other words, the stacking space for sheets S is increased.

Figure 6:
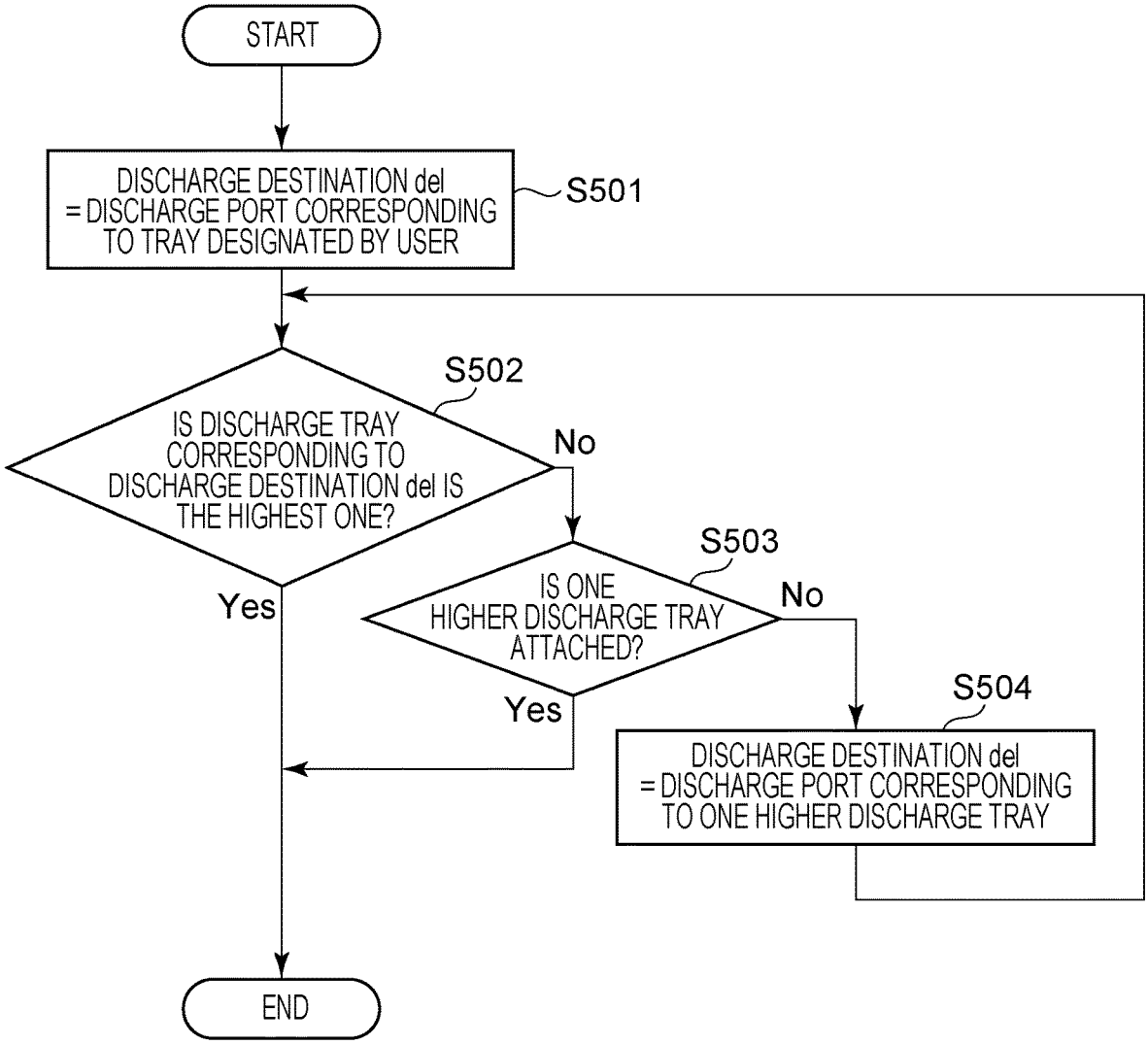
FIG. 6 is a flowchart for determining a discharge destination of a sheet after the discharge tray is detached.

FIG. 6 is a flowchart for determining a discharge destination of a sheet S in a case where a discharge tray (which is any arbitrary discharge tray without a reference) is detached from the apparatus main body 220. A control illustrated in the flowchart is executed based on a program stored in a ROM, not illustrated, in the sorting apparatus control unit 303 illustrated in FIG. 3.

First, the sorting apparatus control unit 303 receives, from a user through the controller 301, information regarding a designated sheet S discharge destination. It is assumed here that the discharge tray 211 is designated. The sorting apparatus control unit 303 selects the discharge port 204 corresponding to the designated discharge tray 211 as a discharge destination del (S501). Next, the sorting apparatus control unit 303 determines whether the discharge tray 211 corresponding to the selected discharge destination del is the highest discharge tray (S502). If so, the sorting apparatus control unit 303 sets the sheet S discharge destination. If it is not the highest discharge tray, the sorting apparatus control unit 303 determines whether the one higher discharge tray 210 than the discharge tray 211 corresponding to the discharge destination del is attached to the apparatus main body 220 by using the tray detecting sensors 407, 408, and 409 (S503). If the one higher discharge tray 210 is attached to the apparatus main body 220, the sorting apparatus control unit 303 sets the sheet S discharge destination. If the one higher discharge tray 210 is not attached to the apparatus main body 220, the sorting apparatus control unit 303 updates the discharge destination del to the discharge port 203 corresponding to the one higher discharge tray 210 (S504). After that, the sorting apparatus control unit 303 returns to S502 to continue the determination until the sheet S discharge destination is set.

According to this embodiment, because the discharge tray 210 is detached and the discharge tray 211 is designated by a user, the discharge port 203 is eventually set as a sheet S discharge destination. In other words, a sheet S is discharged from the discharge port 203 and falls to and is stacked in the discharge tray 211 arranged below the discharge tray 210.

Description of Operations after Discharge Tray is Attached while Sorting

Next, operations to be performed by the sheet sorting apparatus 200 will be described in a case where a discharge tray is attached to the apparatus main body 220 again while a sheet S is being sorted. According to this embodiment, a case will be described where the discharge tray 210 is attached to the apparatus main body 220 while a sheet S is being sorted to the discharge tray 211.

FIG. 5B illustrates a state that a sheet S' has already been stacked on the discharge tray 211 and the discharge tray 210 is attached to the apparatus main body 220. When the tray detecting sensors 407, 408, and 409 detect a change of the attachment states of the discharge trays while a sheet S is being sorted, the sorting apparatus control unit 303 clears information regarding the discharge destination of the sheet S that is being conveyed and monitors the discharge detecting sensors 440, 441, and 442. The sorting apparatus control unit 303 memorizes the discharge port with the one of the discharge detecting sensors 440, 441, and 442 which detects the sheet S first as a discharge destination of the subsequent sheet S and controls the switch members 402 and 403 to discharge the subsequent sheet S to the memorized discharge destination.

In a case where the discharge tray 210 is attached to the apparatus main body 220 while a sheet S is being sorted, two discharge destinations may be considered for the sheet S to be discharged first in accordance with the time of the attachment.

In one case, because the sheet S being conveyed to the discharge port 203 is to be discharged to the designated discharge tray 211, there is time for changing the discharge destination of the sheet S to the discharge port 204. In this case, the subsequent sheet S is also discharged to the discharge port 204, the continuity of the page order with respect to the sheet S' already stacked in the discharge tray 211 can be maintained. However, some positions of the sheet S that is being conveyed may not provide time for changing the discharge destination. More specifically, when the front edge of the sheet S while being conveyed has already passed by the switch member 402, that is, a branch point of the conveyance guide 201, the discharge destination of the sheet S cannot be changed from the discharge port 203 to the discharge port 204. Whether there is time for changing the discharge destination of the sheet S or not may be determined by the sorting apparatus control unit 303 based on a time period passed from a time when the sheet S is fed from the cassette 105. The sorting apparatus control unit 303 can estimate the position of the front edge of the sheet S based on the elapsed time period and the conveying speed of the sheet S.

In the other case, there is not time for changing the discharge destination, and the first sheet S after the discharge tray 210 is attached is discharged from the discharge port 203 to the discharge tray 210. FIG. 5C illustrates this case. When the sheet S' has already been stacked on the discharge tray 211, a sheet S" belonging to the same job is discharged to the discharge tray 210. This case will be described in detail below.

Figure 7:
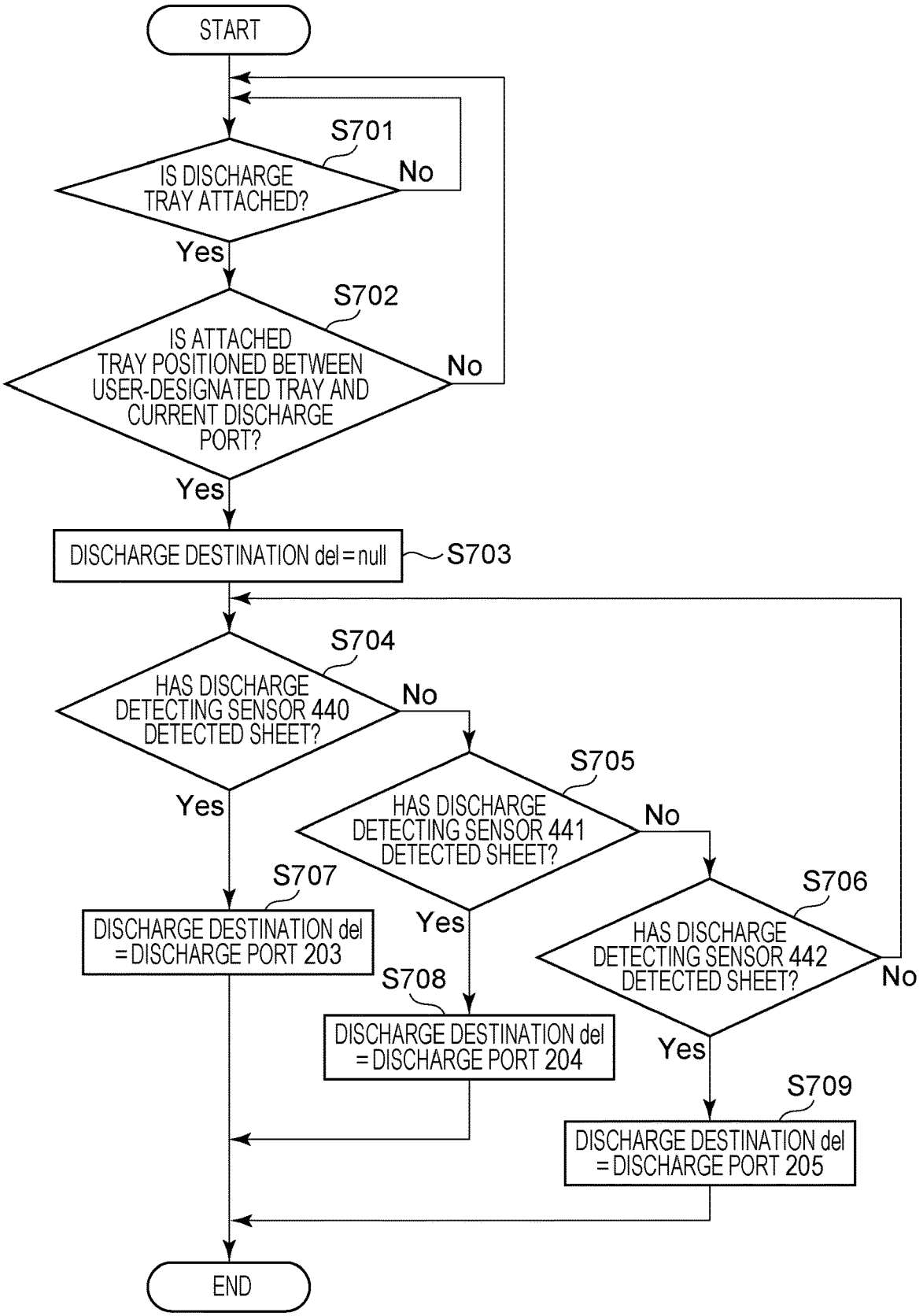
FIG. 7 is a flowchart for determining a discharge destination of a sheet after the discharge tray is attached.

FIG. 7 is a flowchart for determining the discharge destination of the sheet S in a case where the discharge tray is attached to the apparatus main body 220 while a sheet S is being sorted. The control based on the flowchart is executed based on a program stored in a ROM, not illustrated, in the sorting apparatus control unit 303 illustrated in FIG. 3.

First, the sorting apparatus control unit 303 monitors attachment of the discharge trays (S701). When the discharge tray 210 is attached, whether the attached discharge tray 210 is positioned between the discharge tray 211 designated by a user and the discharge port 203 that is the current discharge destination del (S702). As apparent from the fact that the sheet S is dropped from the discharge port 203 and is discharged to the discharge tray 211, the discharge tray 210 is positioned between the discharge tray 211 and the discharge port 203. The sorting apparatus control unit 303 clears the discharge destination del and monitors the discharge destination (S703). The sorting apparatus control unit 303 monitors the discharge detecting sensors 440, 441, and 442 (S704, S705, S706), and the discharge port having the discharge detecting sensor which detects the discharge of the sheet S first is registered as a discharge destination del (S707, S708, S709). The subsequently conveyed sheet S is discharged to the discharge destination indicated by the discharge destination del.

In other words, referring to the flowchart in FIG. 7, in a case where there is not time for changing the discharge destination and the first sheet S is discharged from the discharge port 203 to the discharge tray 210, the subsequent sheet S is discharged to the discharge port 203 even when the discharge tray 211 is designated as a discharge destination. This control continues until a fully-stacked condition of the discharge tray 210 is detected. After detection of the fully-stacked condition, an alert may be issued to deactivate the printing operation. Alternatively, a discharge tray without the sheet S may be selected to continue the printing. Alternatively, a discharge tray not having a fully-stacked condition may be selected to continue the printing, for example. In all of these cases, when the discharge port is changed, the discharge destination del is updated for control.

According to this embodiment, as described above, when a discharge tray is attached to the apparatus main body 220 while a sheet S is being sorted, the sheet S can be sorted such that the page order of the sheets S can be maintained.

Embodiment 2

According to a second embodiment, a method for cancelling the control for forcedly changing the discharge destination of a sheet S will be described. Because Embodiment 1 and Embodiment 2 are substantially the same, differences from Embodiment 1 will only be described.

Under the control according to Embodiment 1, in a case where the discharge tray 210 is attached while a sheet S is being sorted and the discharge destination of the sheet S is changed to the newly attached discharge tray 210, the subsequent sheets S are discharged until the attached discharge tray 210 has a fully-stacked condition. However, the sheets S' already stacked in the discharge tray 211 that has been originally designated may be removed such that the page order of the sheets S can be maintained even though the subsequent sheets S are discharged to the discharge tray 211.

Accordingly, the forced change of the discharge destination of the sheets S can be cancelled.

While the forced change of the discharge destination of sheets S is being performed, the originally designated discharge tray 211 is not used. As a result, the number of dischargeable sheets S of the sheet sorting apparatus 200 as a whole is temporarily reduced. Immediate determination of the possibility of cancellation of the forced change of the discharge destination of sheets S can prevent the reduction of the number of dischargeable sheets S of the sheet sorting apparatus 200 as a whole.

Configuration of Image Forming Apparatus

Figure 8:
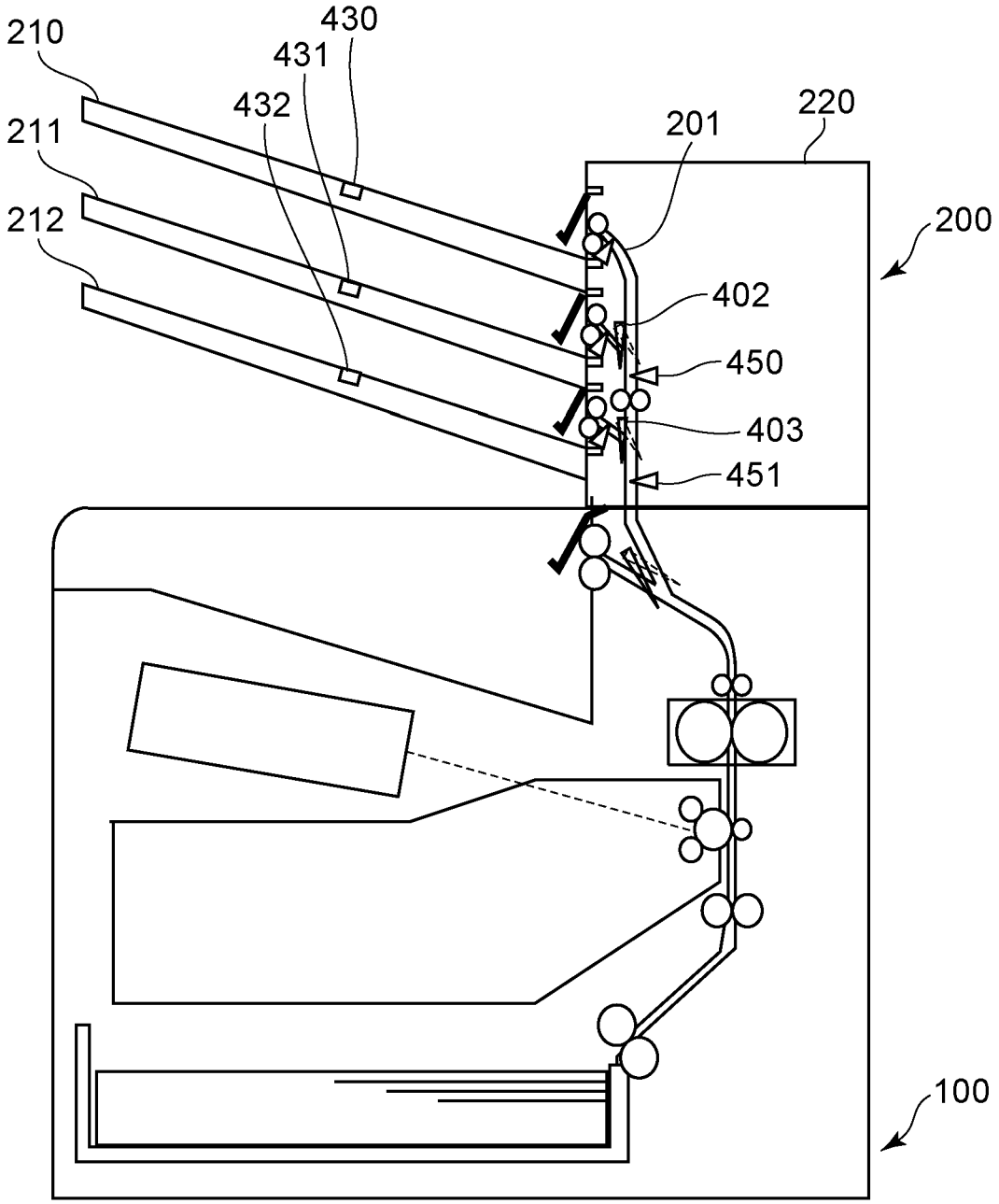
FIG. 8 illustrates a configuration of an image forming apparatus and a sheet sorting apparatus according to Embodiment 2.

With reference to FIG. 8, the sheet sorting apparatus 200 according to this embodiment will be described. This embodiment is different from Embodiment 1 in that sheet detecting sensors 430, 431, and 432 and conveyance detecting sensors 450 and 451 are provided.

The sheet detecting sensors 430, 431, and 432 are sensors configured to detect the presence of a sheet S stacked in the discharge trays 210, 211, and 212, respectively. The sheet detecting sensors 430, 431, and 432 may be photo-interruptors, for example, and be configured to output an OFF signal in a through-beam mode in which a sheet S is not stacked in the discharge trays 210, 211, and 212 and light beams from the photo-interruptors are not shielded by flags, not illustrated. The sheet detecting sensors 430, 431, and 432 may be configured to output an ON signal in a beam shielded mode in which a sheet S is stacked in the discharge trays 210, 211, and 212 and light beams from the photo-interruptor are shielded by flags, not illustrated.

The conveyance detecting sensors 450 and 451 are provided along the conveyance guide 201. The conveyance detecting sensors 450 and 451 are configured to detect a sheet S that is being conveyed. The conveyance detecting sensor 450 is provided at a position on an upstream side of a branch point for the discharge port 203 and the discharge port 204, that is, on an upstream side of the switch member 402. The conveyance detecting sensor 451 is provided at a position on an upstream side of a branch point for the discharge port 204 and the discharge port 205, that is, on an upstream side of the switch member 403.

Control Unit and Functional Components

Figure 9:
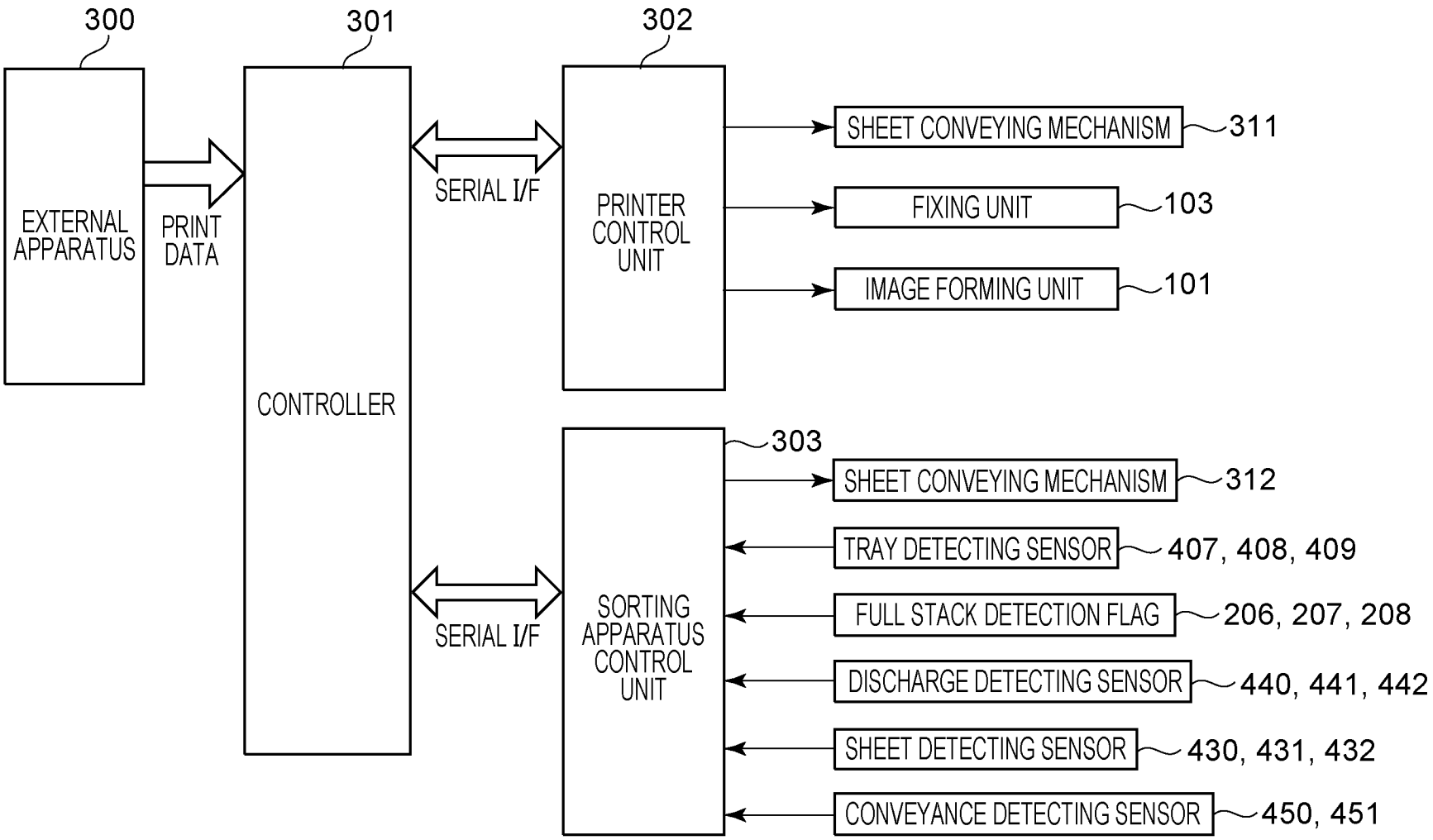
FIG. 9 is a block diagram illustrating a control unit and functional components in the image forming apparatus according to Embodiment 2.

FIG. 9 is a block diagram illustrating functional components according to this embodiment. The illustrated configuration is different from that of Embodiment 1 in that the sheet detecting sensors 430, 431, and 432 and the conveyance detecting sensors 450 and 451 are provided.

The sorting apparatus control unit 303 can grasp the position of a sheet S that is being conveyed by using the conveyance detecting sensors 450 and 451 and determines whether there is time for changing the discharge destination of the sheet S based on a time when a discharge tray is attached while the sheet S is being sorted. In a case where, for example, like Embodiment 1, the discharge tray 210 is attached while a sheet S is being sorted from the discharge port 203 to the discharge tray 211 and if the conveyance detecting sensor 450 detects the sheet S that is being conveyed, the sorting apparatus control unit 303 determines that there is not time for changing the discharge destination. On the other hand, the sorting apparatus control unit 303 determines there is time for changing the discharge destination if the conveyance detecting sensor 450 does not detect the sheet S that is being conveyed. The sorting apparatus control unit 303 further detects the presence of a sheet S stacked in the discharge trays 210, 211, and 212 based on detection results from the sheet detecting sensors 430, 431, and 432.

Details of Sorting Apparatus Control Unit

Figure 10:
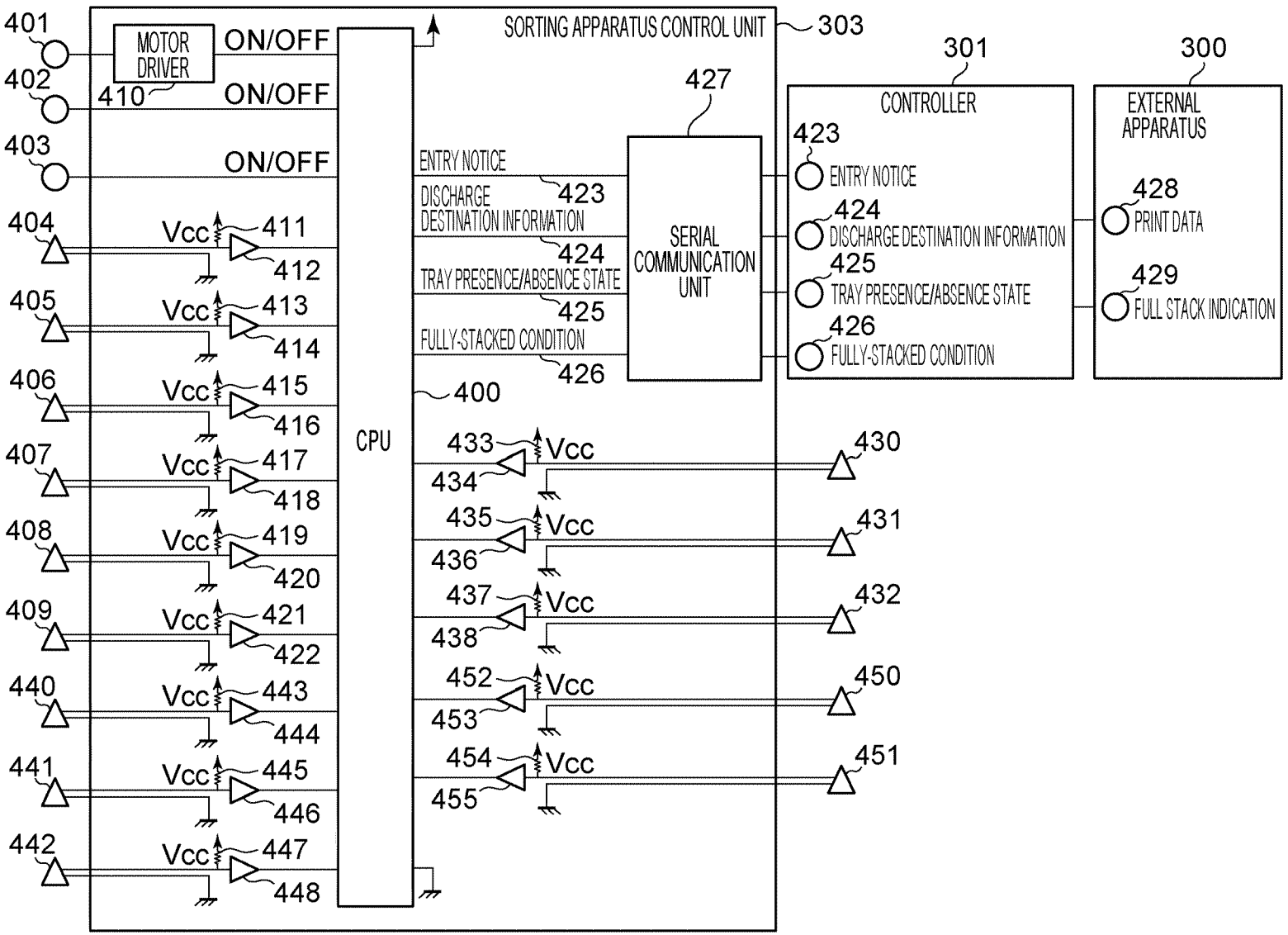
FIG. 10 illustrates details of the sorting apparatus control unit according to Embodiment 2.

FIG. 10 illustrates details of the sorting apparatus control unit 303 according to this embodiment. The sheet detecting sensor 430 uses a pullup 433 to input a sensor state (ON signal or OFF signal) to the CPU 400 through a buffer 434. Because details of the sheet detecting sensors 431 and 432 are the same as those of the sheet detecting sensor 430, any repetitive descriptions will be omitted.

The conveyance detecting sensor 450 uses a pullup 452 to input a sensor state (ON signal or OFF signal) to the CPU 400 through a buffer 453. Because details of the conveyance detecting sensor 451 are the same as those of the conveyance detecting sensor 450, any repetitive descriptions will be omitted.

Description of Operations after Sheet is Removed

Next, operations will be described in a case where a sheet S stacked in the originally designated discharge tray 211 is removed by a user during an operation for forcedly changing the discharge destination of the sheet S. A state will be described that, while the discharge tray 211 is being designated, the discharge destination of a sheet S is forcedly changed to the discharge port 203.

In this state, as illustrated in FIG. 5C, a sheet S' in the first half of a job is stacked in the discharge tray 211, and a sheet S" in the second half of the job is stacked in the discharge tray 210. It is assumed here that sheets S are being continuously discharged to the discharge tray 210. If a user removes a sheet S' that has been already stacked in the discharge tray 211 here, the user has the sheet S' in the first half of the job, and the sheet S" in the second half of the job is stacked in the discharge tray 210. In other words, these sheets may be combined so that the page order of the printed sheets S can be maintained. Therefore, no issue occurs if the forced change of the discharge destination of the sheets S is cancelled.

Figure 11:
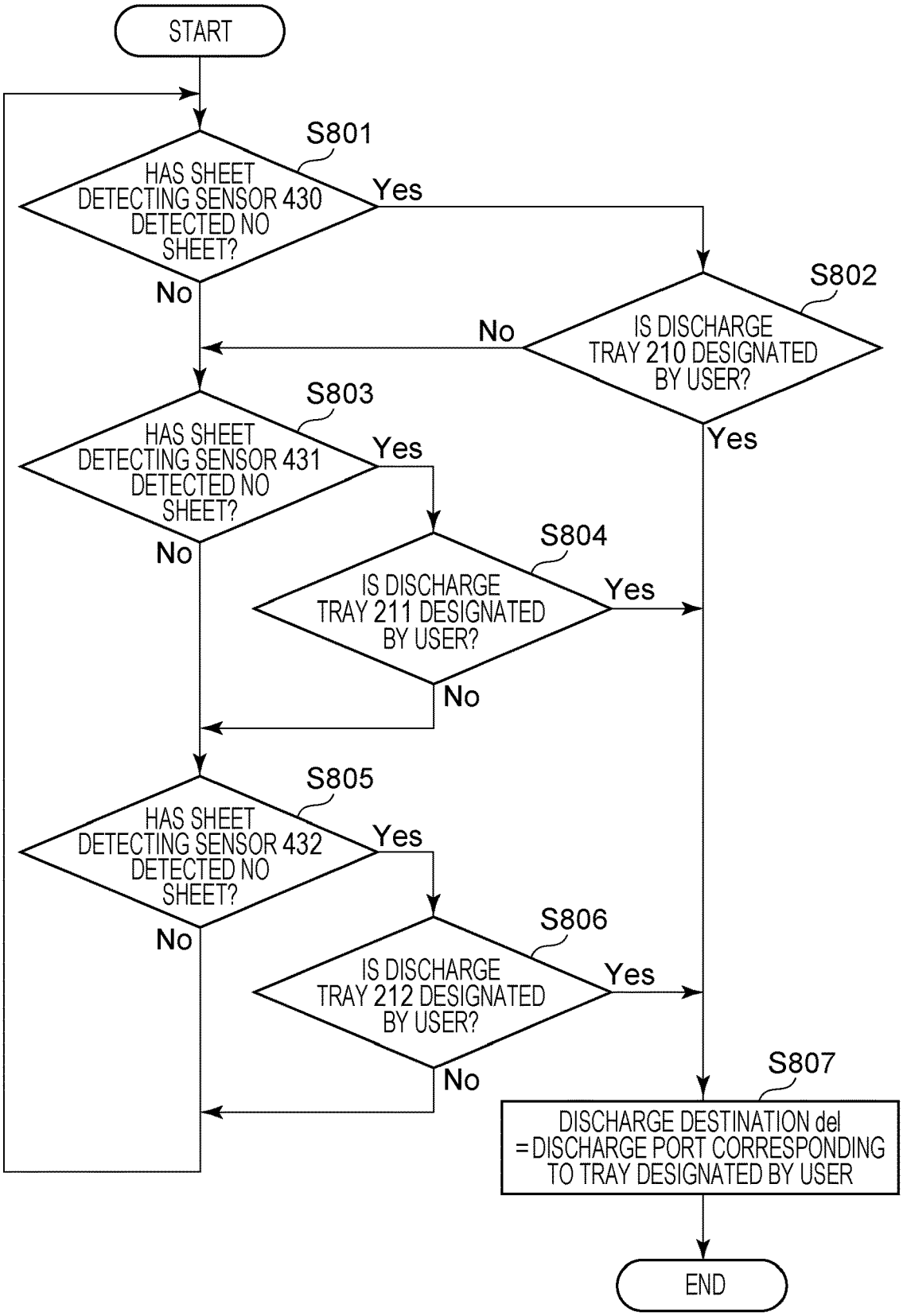
FIG. 11 is a flowchart for determining a discharge designation of a sheet after the sheet is taken out from a discharge tray.

FIG. 11 is a flowchart for, in a case where a sheet S that has been stacked in the designated discharge tray is removed, determining the discharge destination of the sheet S. A control illustrated in the flowchart is executed based on a program stored in a ROM, not illustrated, in the sorting apparatus control unit 303 illustrated in FIG. 9.

First, the sorting apparatus control unit 303 checks whether the sheet detecting sensor 430 has detected no sheet (S801). In other words, whether there is a change from a state with a sheet to a state without a sheet is determined. If no sheet has been detected, the sorting apparatus control unit 303 determines whether the discharge tray 210 corresponding to the sheet detecting sensor 430 is the discharge tray designated by a user (S802). If the discharge tray 210 is the discharge tray designated by a user, the sorting apparatus control unit 303 sets the discharge destination del to the discharge tray 210 designated by a user (S807).

If the discharge tray 210 is not the discharge tray designated by a user or if the sheet detecting sensor 430 has not detected no sheet, the sorting apparatus control unit 303 checks whether the sheet detecting sensor 431 has detected no sheet (S803). If no sheet has been detected, the sorting apparatus control unit 303 determines that the discharge tray 211 corresponding to the sheet detecting sensor 431 is the discharge tray designated by a user (S804). If the discharge tray 211 is the discharge tray designated by a user, the sorting apparatus control unit 303 sets the discharge destination del to the discharge tray 211 designated by a user (S807).

If the discharge tray 211 is not the discharge tray designated by a user or if the sheet detecting sensor 431 has not detected no sheet, the sorting apparatus control unit 303 checks whether the sheet detecting sensor 432 has detected no sheet (S805). If no sheet has been detected, the sorting apparatus control unit 303 determines whether the discharge tray 212 corresponding to the sheet detecting sensor 432 is the discharge tray designated by a user (S806). If the discharge tray 211 is the discharge tray designated by a user, the sorting apparatus control unit 303 sets the discharge destination del to the discharge tray 211 designated by a user (S807). The control based on the flowchart ends here.

According to this embodiment, removal of a printed sheet S from the designated discharge tray triggers cancellation of the forced change of the discharge destination. However, embodiments are not limited thereto. For example, in a configuration one job from one user can be detected by the controller 301 or the external apparatus 300, an end of the job may trigger cancellation of forced change of the discharge destination.

According to this embodiment, the page order of sheets S can be maintained, and more sheets S can be sorted, in addition to the benefits of the Embodiment 1.

According to Embodiment 1, whether there is time for changing the discharge destination of a sheet S is determined based on a time period passed from time when the sheet S is fed from the cassette 105. However, embodiments are not limited thereto. Like Embodiment 2, the conveyance detecting sensors 450 and 451 may further be provided, and whether there is time for changing the discharge destination of a sheet S may be determined based on the detection results from those sensors. Furthermore, based on the time periods passed from the times when the conveyance detecting sensors 450 and 451 detect a sheet S, whether there is time for changing the discharge destination of the sheet S may be determined.

Having described that, according to Embodiment 2, the conveyance detecting sensors 450 and 451 are used to determine whether there is time for changing the discharge destination of a sheet S, it may be determined based on the time period passed from feeding of the sheet S from the cassette 105 as in Embodiment 1.

According to Embodiments 1 and 2, the sheet S discharged first after a discharge tray is attached is detected by the discharge detecting sensors 440, 441, and 442 to set the discharge destination for the subsequent sheet S. However, embodiments are not limited thereto. The sheet detecting sensors 430, 431, and 432 may detect the sheet S discharged first after a discharge tray is attached.

According to Embodiments 1 and 2, the full stack detection flag 207 and the discharge tray 210 are integrated. However, they may be detachable separately, or only the discharge tray 210 may be detachable. When the full stack detection flag 207 is not detachable from the apparatus main body 220, the full stack detection flag 207 can be retracted to an internal part of the apparatus main body 220 not to disturb discharging of a sheet S from the discharge port 203 to the discharge tray 211.

According to Embodiments 1 and 2, all of the trays 210, 211, 212 are detachable from the apparatus main body 220. However, embodiments of the present disclosure are not limited thereto. Only the discharge tray 210 may be detachable, and the discharge trays 211 and 212 may not be detachable. In other words, at least one discharge tray may be detachable from the apparatus main body 220 excluding the lowest discharge tray in the perpendicular direction.

The present disclosure is applicable to a case where the discharge trays 210, 211, and 212 are detached from the apparatus main body 220 to increase the sheet stacking space of the discharge tray 124. In this case, the full stack detection flag 125 may be detached integrally with the discharge tray 212.

According to Embodiments 1 and 2, the printer control unit 302 and the sorting apparatus control unit 303 are separately provided. However, only the printer control unit 302 may be provided. In this case, the printer control unit 302 may control the sheet sorting apparatus 200.

According to Embodiments 1 and 2, the sheet sorting apparatus 200 may be detachable from the printer 100 or may be fixed integrally to the printer 100.

Having described that, according to Embodiments 1 and 2, three discharge trays 210, 211, and 212 are provided, the number of discharge trays is not limited to three. The number of discharge trays may be set in accordance with the environment in which the sheet sorting apparatus 200 is to be used, the number of users sharing the sheet sorting apparatus 200 or specifications of the sheet sorting apparatus 200.

According to Embodiments 1 and 2, the image forming apparatus is a laser beam printer, for example. However, the image forming apparatus to which the present disclosure is applied is not limited thereto but may be a printer or a copier based on other printing methods such as an ink-jet printer.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-032598, filed Feb. 26, 2018, which is hereby incorporated by reference herein in its entirety.

What is claimed is:

1. A sheet sorting apparatus comprising:

a first tray detachable from an apparatus main body;

a second tray arranged below the first tray, wherein the apparatus main body has a first discharge port at a position corresponding to the first tray and a second discharge port at a position corresponding to the second tray;

a discharge unit configured to discharge a sheet toward the first discharge port or the second discharge port;

a tray detecting unit configured to detect that the first tray is attached to the apparatus main body; and a control unit configured to control the discharge unit, wherein the control unit causes the discharge unit to discharge a first sheet from the first discharge port toward the second tray in a state in which the first tray is detached from the apparatus main body, wherein, in a case where there is a change from the state in which the first tray is detached into a state in which the first tray is attached to the apparatus main body and in addition where a discharge destination of a second sheet that is discharged after attachment of the first tray is switchable before the second sheet is discharged to the first discharge port, the control unit switches the discharge destination of the second sheet from the first discharge port to the second discharge port and causes the discharge unit to discharge the second sheet from the second discharge port toward the second tray, and wherein the control unit causes the discharge unit to discharge a third sheet, which is discharged next after the second sheet, from the second discharge port toward the second tray.

2. The sheet sorting apparatus according to claim 1, further comprising a conveyance detecting unit provided on a sheet conveyance path and configured to detect a sheet that is being conveyed, wherein the control unit determines, based on a detection result by the conveyance detecting unit, whether there is or is not time for changing the discharge destination of the first sheet from the first discharge port to the second discharge port when the tray detecting unit detects that the first tray is attached to the apparatus main body.

3. The sheet sorting apparatus according to claim 1, wherein, in a case where a front edge of the first sheet that is being conveyed has already passed by a branch point for the first tray and the second tray on a conveyance guide when the tray detecting unit detects that the first tray is attached to the apparatus main body, the control unit determines that there is not time for changing the discharge destination of the first sheet from the first discharge port to the second discharge port.

4. An image forming apparatus comprising:

an image forming unit configured to form an image on a sheet;

a first tray detachable from an apparatus main body;

a second tray arranged below the first tray, wherein the apparatus main body has a first discharge port at a position corresponding to the first tray and a second discharge port at a position corresponding to the second tray;

a discharge unit configured to discharge a sheet having an image formed by the image forming unit toward the first discharge port or the second discharge port;

a tray detecting unit configured to detect that the first tray is attached to the apparatus main body; and a control unit configured to control the discharge unit, wherein, the control unit causes the discharge unit to discharge a first sheet from the first discharge port toward the second tray in a state in which the first tray is detached from the apparatus main body, wherein, in a case where the there is a change from the state in which the first tray is detached into a state in which the first tray is attached to the apparatus main body and in addition where a discharge destination of a second sheet that is discharged after attachment of the first tray is switchable before the second sheet is discharged to the first discharge port, the control unit switches the discharge destination of the second sheet from the first discharge port to the second discharge port and causes the discharge unit to discharge the second sheet from the second discharge port toward the second tray, and wherein the control unit causes the discharge unit to discharge a third sheet, which is discharged next after the second sheet, from the second discharge port toward the second tray.

5. The image forming apparatus according to claim 4, further comprising a conveyance detecting unit provided on a sheet conveyance path and configured to detect a sheet that is being conveyed, wherein the control unit determines, based on a detection result by the conveyance detecting unit, whether there is or is not time for changing the discharge destination of the first sheet from the first discharge port to the second discharge port when the tray detecting unit detects that the first tray is attached to the apparatus main body.

6. The image forming apparatus according to claim 4, wherein, in a case where a front edge of the first sheet that is being conveyed has already passed by a branch point for the first tray and the second tray on a conveyance guide when the tray detecting unit detects that the first tray is attached to the apparatus main body, the control unit determines that there is not time for changing the discharge destination of the first sheet from the first discharge port to the second discharge port.

7. A sheet sorting apparatus comprising:

a first tray detachable from an apparatus main body;

a second tray arranged below the first tray, wherein the apparatus main body has a first discharge port at a position corresponding to the first tray and a second discharge port at a position corresponding to the second tray;

a discharge unit configured to discharge a sheet toward the first discharge port or the second discharge port;

a tray detecting unit configured to detect that the first tray is attached to the apparatus main body; and a control unit configured to control the discharge unit, wherein, the control unit causes the discharge unit to discharge a first sheet from the first discharge port toward the second tray in a state in which the first tray is detached from the apparatus main body, wherein, in a case where there is a change from the state in which the first tray is detached into a state in which the first tray is attached to the apparatus main body and in addition where a discharge destination of a second sheet that is discharged after attachment of the first tray is not switchable before the second sheet is discharged to the first discharge port, the control unit causes the discharge unit to discharge the second sheet from the first discharge port toward the first tray, and wherein the control unit causes the discharge unit to discharge a third sheet, which is discharged next after the second sheet, from the first discharge port toward the first tray.

8. The sheet sorting apparatus according to claim 7, further comprising a sheet detecting unit configured to detect presence of a sheet discharged to the second tray, wherein, in a case where the first sheet is discharged from the first discharge port to the first tray and then there is a change from a state where the sheet detecting unit detects a sheet discharged to the second tray to a state where the sheet detecting unit does not detect the sheet discharged to the second tray, the control unit causes the discharge unit to discharge the second sheet toward the second discharge port.

9. The sheet sorting apparatus according to claim 7, further comprising a conveyance detecting unit provided on a sheet conveyance path and configured to detect a sheet that is being conveyed, wherein the control unit determines, based on a detection result by the conveyance detecting unit, whether there is or is not time for changing the discharge destination of the first sheet from the first discharge port to the second discharge port when the tray detecting unit detects that the first tray is attached to the apparatus main body.

10. The sheet sorting apparatus according to claim 7, wherein, in a case where a front edge of the first sheet that is being conveyed has already passed by a branch point for the first tray and the second tray on a conveyance guide when the tray detecting unit detects that the first tray is attached to the apparatus main body, the control unit determines that there is not time for changing the discharge destination of the first sheet from the first discharge port to the second discharge port.

11. An image forming apparatus comprising:

an image forming unit configured to form an image on a sheet;

a first tray detachable from an apparatus main body;

a second tray arranged below the first tray, wherein the apparatus main body has a first discharge port at a position corresponding to the first tray and a second discharge port at a position corresponding to the second tray;

a discharge unit configured to discharge a sheet having an image formed by the image forming unit toward the first discharge port or the second discharge port;

a tray detecting unit configured to detect that the first tray is attached to the apparatus main body; and a control unit configured to control the discharge unit, wherein, the control unit causes the discharge unit to discharge a first sheet from the first discharge port toward the second tray in a state in which the first tray is detached from the apparatus main body, wherein, in a case where there is a change from the state in which the first tray is detached into a state in which the first tray is attached to the apparatus mains body and in addition where a discharge destination of a second sheet that is discharged after attachment of the first tray is not switchable before the second sheet is discharged to the first discharge port, the control unit causes the discharge unit to discharge the second sheet from the first discharge port toward the first tray, and wherein the control unit causes the discharge unit to discharge a third sheet, which is discharged next after the second sheet, from the first discharge port toward the first sheet is tray.

12. The image forming apparatus according to claim 11, further comprising a sheet detecting unit configured to detect presence of a sheet discharged to the second tray, wherein, in a case where the first sheet is discharged from the first discharge port to the first tray and then there is a change from a state where the sheet detecting unit detects a sheet discharged to the second tray to a state where the sheet detecting unit does not detect the sheet discharged to the second tray, the control unit causes the discharge unit to discharge the second sheet toward the second discharge port.

13. The image forming apparatus according to claim 11, further comprising a conveyance detecting unit provided on a sheet conveyance path and configured to detect a sheet that is being conveyed, wherein the control unit determines, based on a detection result by the conveyance detecting unit, whether there is or is not time for changing the discharge destination of the first sheet from the first discharge port to the second discharge port when the tray detecting unit detects that the first tray is attached to the apparatus main body.

14. The image forming apparatus according to claim 11, wherein, in a case where a front edge of the first sheet that is being conveyed has already passed by a branch point for the first tray and the second tray on a conveyance guide when the tray detecting unit detects that the first tray is attached to the apparatus main body, the control unit determines that there is not time for changing the discharge destination of the first sheet from the first discharge port to the second discharge port.

* * * * *